US008232933B2

(12) United States Patent
Kim

(10) Patent No.: US 8,232,933 B2
(45) **Date of Patent: *Jul. 31, 2012**

(54) ORGANIC LIGHT EMITTING DISPLAY WITH COMPENSATION FOR TRANSISTOR THRESHOLD VARIATION

(75) Inventor: Yangwan Kim, Youngin-si (KR)

(73) Assignee: Samsung Mobile Display Co., Ltd., Yongin-Gyunggi-do (KR)

( * ) Notice: Subject to any disclaimer, the term of this patent is extended or adjusted under 35 U.S.C. 154(b) by 625 days.

This patent is subject to a terminal disclaimer.

(21) Appl. No.: 12/005,699

(22) Filed: Dec. 27, 2007

(65) Prior Publication Data

US 2008/0170010 A1 Jul. 17, 2008

(30) Foreign Application Priority Data

Jan. 16, 2007 (KR) ..... 10-2007-0004860

(51) Int. Cl.
*G09G 3/30* (2006.01)

(52) U.S. Cl. ..... 345/76

(58) Field of Classification Search ..... 345/76
See application file for complete search history.

(56) References Cited

U.S. PATENT DOCUMENTS

| | | | | |
|---|---|---|---|---|
| 6,873,117 | B2 * | 3/2005 | Ishizuka | 315/169.1 |
| 6,975,293 | B2 * | 12/2005 | Yen et al. | 315/169.1 |
| 7,009,591 | B2 * | 3/2006 | Shibusawa | 345/76 |
| 7,187,350 | B2 * | 3/2007 | Yoshida | 345/76 |
| 7,205,965 | B2 * | 4/2007 | Mikami et al. | 345/76 |
| 7,580,015 | B2 * | 8/2009 | Tai et al. | 345/76 |
| 2004/0004443 | A1 | 1/2004 | Park et al. | |
| 2004/0108979 | A1 * | 6/2004 | Seki | 345/76 |
| 2005/0024297 | A1 | 2/2005 | Shin | |
| 2005/0275352 | A1 * | 12/2005 | Sun | 315/169.3 |
| 2006/0055336 | A1 * | 3/2006 | Jeong | 345/77 |
| 2006/0151745 | A1 | 7/2006 | Kim et al. | |
| 2006/0221662 | A1 * | 10/2006 | Park et al. | 365/145 |
| 2006/0238461 | A1 * | 10/2006 | Goh et al. | 345/76 |
| 2007/0057873 | A1 * | 3/2007 | Uchino et al. | 345/76 |
| 2008/0001857 | A1 * | 1/2008 | Yoo | 345/76 |
| 2008/0111804 | A1 | 5/2008 | Choi et al. | |

FOREIGN PATENT DOCUMENTS

| | | | |
|---|---|---|---|
| EP | 1531450 | A2 | 5/2005 |
| EP | 1655719 | A2 | 5/2006 |
| EP | 1 923 857 | A2 | 5/2008 |
| JP | 2005189696 | A * | 7/2005 |
| KR | 10-2006-0018766 | A | 3/2006 |

(Continued)

OTHER PUBLICATIONS

Office Action dated Dec. 29, 2010 for related U.S. Appl. No. 11/879,312, filed Jul. 16, 2007.

(Continued)

*Primary Examiner* — Adam J Snyder

(74) *Attorney, Agent, or Firm* — Knobbe Martens Olson & Bear, LLP

(57) ABSTRACT

An organic light emitting display is disclosed. The display includes a scan line, a data line, and a pixel coupled to the scan line and the data line. The pixel is configured to at least partially compensate for transistor threshold variation and for IR-drop in a power supply line, where the pixel includes no more than three transistors and no more than two capacitors.

19 Claims, 8 Drawing Sheets

FOREIGN PATENT DOCUMENTS

| | | | | |
|---|---|---|---|---|
| KR | 10-2006-0053754 | A | | 5/2006 |
| KR | 1020060064129 | A | | 6/2006 |
| KR | 10-2006-0109343 | A | | 10/2006 |
| KR | 10-2007-02189 | | * | 1/2007 |
| WO | WO 2004/066249 | | | 8/2004 |
| WO | WO 2004104975 | A1 | * | 12/2004 |

OTHER PUBLICATIONS

European Examination Report dated Apr. 18, 2011 for European Application No. EP 08 250 060.4 which shares priority of Korean Patent Application No. KR 10-2007-0004860 with the captioned application.

Office Action dated Oct. 20, 2011 for U.S. Appl. No. 11/879,312, filed Jul. 16, 2007, which is related to captioned U.S. Appl. No. 12/005,699.

Office Action dated Feb. 10, 2012 for U.S. Appl. No. 11/879,312, filed Jul. 16, 2007, which is related to captioned U.S. Appl. No. 12/005,699.

* cited by examiner

ORGANIC LIGHT EMITTING DISPLAY WITH COMPENSATION FOR TRANSISTOR THRESHOLD VARIATION

CROSS-REFERENCE TO RELATED APPLICATION

This application claims priority to and the benefit of Korean Patent Application No. 10-2007-0004860, filed on Jan. 16, 2007, the entire content of which is incorporated herein by reference.

BACKGROUND

1. Field of the Invention

The field relates to an organic light emitting display.

2. Description of the Related Technology

An organic light emitting display has beneficial aspects of being thin, having a wide viewing angle and high speed. The organic light emitting display can control the brightness of each pixel and display an image by controlling the amount of current which flows through an organic light emitting diode (OLED). In the display, once a current corresponding to a data is supplied to an organic light emitting diode, the organic light emitting diode emits light corresponding to the current supplied. The data applied to the organic light emitting diode has a quantized grey scale value within a predetermined range in order to express a grey scale.

When a thin film transistor which has amorphous silicon (a-Si) is used as a driving transistor, it has a weakness in that current driving ability can be relatively low. However, it also has advantages in that the uniformity of the display device is excellent, and it is more suitable for being manufactured in a large size display. The uniformity of the luminance of the display panel can be low because a driving transistor of the respective pixel circuits of the organic light emitting display can have different threshold voltages from one another. Furthermore, one portion of the panel may be brighter than another because IR-drop occurs in a power supply line (VDD) connecting the respective pixel circuits one another. Moreover, in case that the pixel circuit of the organic light emitting display includes many transistors, it is difficult to achieve high resolution of the panel because high integration becomes impossible. In the case of conventional circuits for compensating for the threshold voltage of a driving transistor in the pixel circuit, a path from a control electrode of the driving transistor to a negative power supply is formed, and then a leakage current can flow through the path. Consequently, it can cause an improper emission of the organic light emitting diode.

In addition, in case that RGB data signals are applied to the pixel circuits using a demux, if the emission control signals applied through the emission control line coupled to the pixel circuits are turned off, the RGB data signals can be stored in a storage capacitor of the pixel circuit improperly. When RGB data signals (voltages) are applied continuously by driving the RGB data signals (voltages) to the storage capacitors not yet initialized, accurate RGB data signals (voltages) cannot be stored in the storage capacitors properly.

In the case of a color organic light emitting display, a color display can be accomplished by including the display device with an organic light emitting diode which emits light of three colors of red, green and blue. However, the materials used as an organic light emission layer can be degraded by the heat generated during emission. Because of the degradation, the luminance of the organic light emitting diode can deteriorate. As a result, the life span of the organic light emitting diode can be decreased. Because the degree of the degradation of an organic light emission layer which forms a red, green and blue organic light emission layer differs from one another, the difference of the luminance of the red, green and blue organic light emission layer can become larger as time goes by. Accordingly, the desired color cannot be reproduced accurately because transition of the color data occurs as the white balance is changed compared with the initial value. Because each emission layer corresponding to red, green and blue color has a different life span from one another, it is difficult to maintain the white balance when the emission layer is driven for a long time.

SUMMARY OF CERTAIN INVENTIVE ASPECTS

One aspect is an organic light emitting display, including a scan line, a data line, and a pixel coupled to the scan line and the data line. The pixel includes a first switching transistor including a control electrode coupled to the scan line, and a first electrode coupled to the data line. The pixel also includes a driving transistor coupled between a first power supply line and a second power supply line, the driving transistor including a control electrode coupled to the first switching transistor. The pixel also includes a first storage capacitor connected to the first switching transistor, the first power supply line and the driving transistor. The pixel also includes a second switching transistor coupled between the first power supply line and the driving transistor, the second switching transistor including a control electrode coupled to an emission control line. The pixel also includes a second storage capacitor connected to the first switching transistor, the first storage capacitor, the second switching transistor and the driving transistor, and an organic light emitting diode coupling between the driving transistor and the second power supply line.

Another aspect is an organic light emitting display, including a scan line, a data line, and a pixel coupled to the scan line and the data line, the pixel configured to at least partially compensate for transistor threshold variation and for IR-drop in a power supply line, where the pixel includes no more than three transistors.

DETAILED DESCRIPTION OF CERTAIN INVENTIVE EMBODIMENTS

Figure 1:
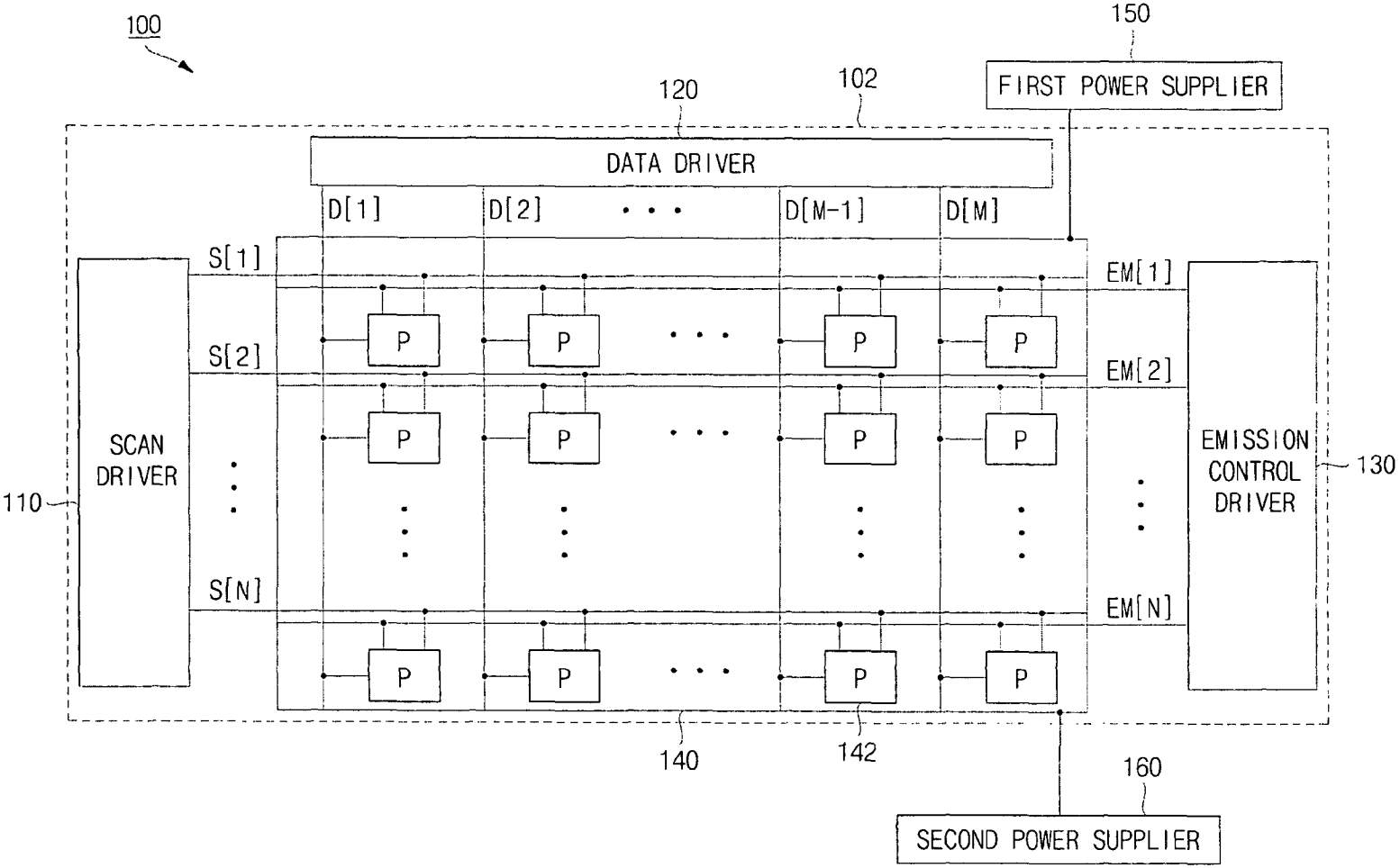
FIG. 1 is a block diagram of the basic structure of an organic light emitting diode display.

Referring to FIG. 1, an organic light emitting display is depicted as a block diagram.

As shown in FIG. 1, an organic light emitting display 100 can include a scan driver 110; a data driver 120; an emission control driver 130; an organic light emitting display panel 140 (hereinafter, referred to as panel 140); a first power supply 150; and a second power supply 160.

The scan driver 110 can supply the panel 140 with a scan signal through a plurality of scan lines (S[1], . . . , S[N]) in sequence.

The data driver 120 can supply the panel 140 with a data signal through a plurality of data lines (D[1], . . . , D[M]).

The emission control driver 130 can supply the panel 140 with an emission control signal through a plurality of emission control lines (EM[1], . . . , EM[N]) in sequence.

In addition, the panel 140 can include a plurality of scan lines (S[1], . . . , S[N]) arranged in column direction, a plurality of emission control lines (D[1], . . . , D[M]) arranged in column direction, a plurality of data lines (D[1], . . . , D[M]) arranged in row direction, and a pixel circuit (142, Pixel) which is defined by the scan lines (S[1], . . . , S[N]), the emission control lines (EM[1], . . . , EM[N]) and the data lines (D[1], . . . , D[M]).

Here, the pixel circuit (140, Pixel) can be formed at the pixel region which is defined by the scan lines and the data lines. As described above, the scan lines (S[1], . . . , S[N]) can be supplied with a scan signal from the scan driver 110, and the data lines (D[1], . . . , D[M]) can be supplied with a data signal from the data driver 120, and the emission control signal line (EM[1], . . . , EM[N]) can be supplied with an emission control signal from the emission control driver 130.

The first power supply 150 and the second power supply 160 supply each pixel circuit 142 placed at the panel 140 with a first power supply voltage and a second power supply voltage.

As shown in FIG. 1, the scan driver 110, the data driver 120, the emission control driver 130, the panel 140, the first power supply 150 and the second power supply voltage driver 140 can be formed on one substrate 102.

Particularly, the drivers and power supply voltage suppliers 110, 120, 130, 150 and 160 can be formed on the same layer as the layer on which the scan lines (S[1], . . . , S[N]), the data lines (D[1], . . . , D[M]), the emission control lines (EM[1], . . . , EM[N]), and a transistor (not shown in drawings) of the pixel circuit 142 are formed. Of course, the drivers and the power supply voltage suppliers 110, 120, 130, 150 and 160 can be formed on another substrate (not shown in drawings), which can be coupled to the substrate 102. Furthermore, the drivers and the power supply voltage suppliers 110, 120, 130, 150 and 160 can be formed in a form such as TCP (Tape Carrier Package), FPC (Flexible Printed Circuit), TAB (Tape Automatic Bonding), COG (Chip On Glass), and the equivalent thereof, which couple the drivers and the suppliers to the substrate 102. However, the form and the location of the drivers and the suppliers 110, 120, 130, 150 and 160 are not limited.

Figure 2:
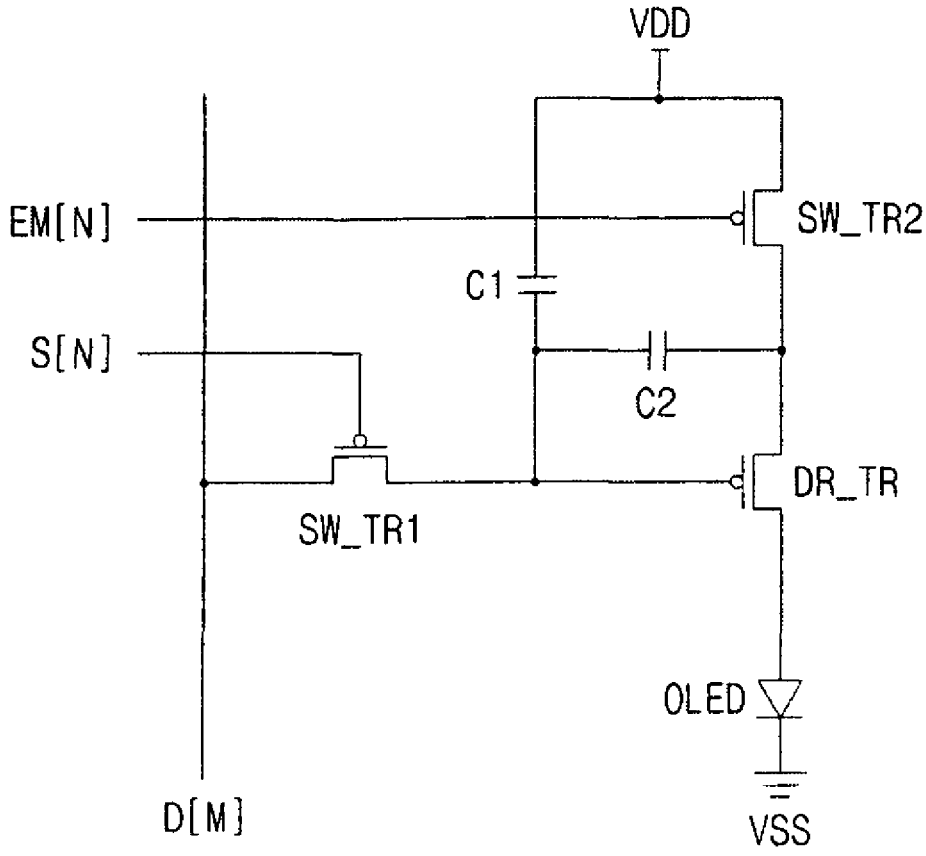
FIG. 2 is a circuit diagram depicting a pixel circuit according to an exemplary embodiment of the organic light emitting diode display.

Referring to FIG. 2, a circuit diagram of a pixel circuit according to one embodiment of the organic light emitting display is depicted. A pixel circuit which will be described in the following means the pixel circuit formed on the panel 140 shown in FIG. 1.

As shown in FIG. 2, the pixel circuit of the organic light emitting display can include a scan line (S[N]); a data line (D[M]); an emission control line (EM[N]); a first power supply line (VDD); a second power supply line (VSS); a first switching transistor (SW_TR1); a second switching transistor (SW_TR2); a driving transistor (DR_TR); a first storage capacitor (C1); a second storage capacitor (C2); and an organic light emitting diode (OLED).

The scan line (S[N]) supplies a control electrode of the first switching transistor (SW_TR1) with a scan signal which selects an organic light emitting diode (OLED) which will emit light. The scan line (S[N]) can be coupled to the scan driver 110 (referring to FIG. 1) which generates a scan signal.

The data line (D[M]) supplies a second electrode of the first storage capacitor, a second electrode of the second storage capacitor, and a control electrode of the driving transistor (DR_TR) with a data signal (voltage) which is in proportion to the luminance. The data line (D[M]) can be coupled to the data driver 120 (referring to FIG. 1) which generates a data signal.

The emission control line (EM[N]) supplies a control electrode of the second switching transistor (SW_TR2) with an emission control signal as it is coupled to the control electrode of the second switching transistor (SW_TR2). Once the second switching transistor (SW-TR2) is turned on by the emission control signal, a first power supply voltage from the first power supply line (VDD) can be applied to a first electrode of the first storage capacitor (C1), a first electrode of the second storage capacitor (C2) and a first electrode of the first driving transistor (DR_TR). The emission control line (EM[N]) can be coupled to the emission control driver 130 (referring to FIG. 1) which generates an emission control signal.

The first power supply line (VDD) supplies the organic light emitting diode (OLED) with a first power supply voltage. The first power supply line (VDD) can be coupled to the first power supply 150 (referring to FIG. 1) which supplies a first power supply voltage.

The second power supply line (VSS) supplies the organic light emitting diode (OLED) with a second power supply voltage. The second power supply line (VSS) can be coupled to the second power supply 160 (referring to FIG. 1) which supplies a second power supply voltage. Here, the first power supply voltage can have a higher voltage level than that of the second power supply voltage in general.

In addition, the second power supply voltage can use a ground voltage.

The first switching transistor (SV_TR1) can include a first electrode (source or drain electrode) coupled to the data line (D[M]); a second electrode (source or drain electrode) coupled to a control electrode (gate electrode) of the driving transistor (DR_TR), a second electrode of the first storage capacitor (C1) and a second electrode of the second storage capacitor (C2); and a control electrode (gate electrode) coupled to the scan line (S[N]). The first switching transistor (SW_TR1) can be a P type channel transistor. Once the first switching transistor (SW_TR1) is turned on by the scan signal of low level applied to the control electrode through the scan line (S[N]), the first switching capacitor (SW_TR1) applies a data voltage to a second electrode of the first storage capacitor (C1), a second electrode of the second storage capacitor (C2) and a control electrode of the driving transistor (DR_TR) through the data line (D[M]).

The driving transistor (DR_TR) can include a first electrode coupled to a first electrode of the second storage capacitor (C2) and a second electrode of the second switching transistor (SW_TR2); a second electrode coupled to an anode of the organic light emitting diode (OLED); and a control electrode coupled to the second electrode of the first switching transistor (SW_TR1), a second electrode of the first storage capacitor (C1) and a second electrode of the second storage capacitor (C2). The driving transistor can be a P type channel transistor. A method for driving the driving transistor (DR_TR), according to an embodiment, supplies an amount of current from the first power supply line (VDD) to the organic light emitting diode (OLED), once the driving transistor (DR_TR) is turned on by the signal of low level applied to the control electrode. A data signal is supplied to the storage capacitors, and is stored in the storage capacitors. Consequently, even if the electric connection with the data line (D[M]) is discontinued as the first switching transistor (SW_TR1) is turned off, a signal of low level can be applied to the control electrode of the driving transistor (DR_TR) continuously by the voltage charged in the storage capacitors.

The driving transistor (DR_TR) can be, for example, any one selected from an amorphous silicon thin film transistor, a poly silicon thin film transistor, an organic thin film transistor, a nano thin film transistor, and the equivalent thereof. However, the material or the kind of the driving transistor is not limited.

When the driving transistor (DR_TR) is a poly silicon thin film transistor, there are various crystallization methods such as an laser crystallization method (excimer laser annealing: ELA) using an excimer laser, a metal induced crystallization (MIC) using catalytic metals, a solid phase crystallization, a high pressure annealing wherein a crystallization is executed at a high temperature and a high humidity environment, and a sequential lateral solidification (SLS) using a mask in addition to a conventional laser crystallization.

The organic light emitting diode (OLED) can include an anode coupled to the second electrode of the driving transistor (DR_TR) and a cathode coupled to the second power supply line (VSS). The organic light emitting diode (OLED) emits light in a luminance determined by the current controlled through the driving transistor (DR_TR) while the second switching transistor (SW_TR2) is turned on.

The organic light emitting diode (OLED) includes an emission layer (not shown). The emission layer can be, for example, any one selected from a fluorescent material, a phosphorescent material, a mixture of them, and the equivalent thereof. However, the material or the kind of the emission layer is not limited.

In addition, the emission layer can be, for example, one selected from a red emitting material, a green emitting material, a blue emitting material, a mixture of them, and the equivalent of them. However, the material or the kind of the emission layer is not limited to this exemplary embodiment.

The second switching transistor (SW_TR2) includes a first electrode coupled to the first power supply line (VDD) and a first electrode of the first storage capacitor (C1); a second electrode coupled to a first electrode of the second storage capacitor (C2) and the first electrode of the driving transistor (DR_TR); and a control electrode coupled to the emission control line (EM[N]). The second switching transistor (SW_TR2) in this embodiment is a P type channel transistor. Once the second switching transistor (SW_TR2) is turned on by the signal of low level applied to the control electrode through the emission control line (EM[N]), a current flows from the first power supply line (VDD) to the organic light emitting diode (OLED).

The first storage capacitor (C1) includes a first electrode coupled to the first power supply line (VDD) and the first electrode of the second switching transistor (SW_TR2), and a second electrode coupled to a second electrode of the second storage capacitor (C2), the second electrode of the first switching transistor (SW_TR1) and the control electrode of the driving transistor (DR_TR).

The second storage capacitor (C2) includes a first electrode coupled to the second elelctrode of the second switching transistor (SW_TR2) and the first electrode of the driving transistor (DR_TR), and a second electrode coupled to the second electrode of the first storage capacitor (C1), the second electrode of the first switching transistor (SW_TR1) and the control electrode of the driving transistor (DR_TR).

The second storage capacitor (C2) maintains a data signal voltage and the threshold voltage of the driving transistor for a period. In addition, once the second switching transistor (SW_TR2) is turned on (as a signal of low level is applied to the control electrode of the second switching transistor (SW_TR2) by the emission control line (EM[N]), the voltage on the second storage capacitor (C2) controls a current, which is in proportion of the strength of a data signal, from the first power supply line to the organic light emitting diode. Consequently, the organic light emitting diode emits light. Furthermore, the compensation for IR-drop or the threshold voltage of the driving transistor which will be described in the following can be accomplished by controlling the capacitance ratio (C1:C2) of the first storage capacitor to the second storage capacitor.

The first switching transistor (SW_TR1), the driving transistor (DR_FR) and the second switching transistor (SW_TR2) can, for example, be any one selected from a P type channel transistor and its equivalent. However, the kind of the transistor is not limited.

Figure 3:
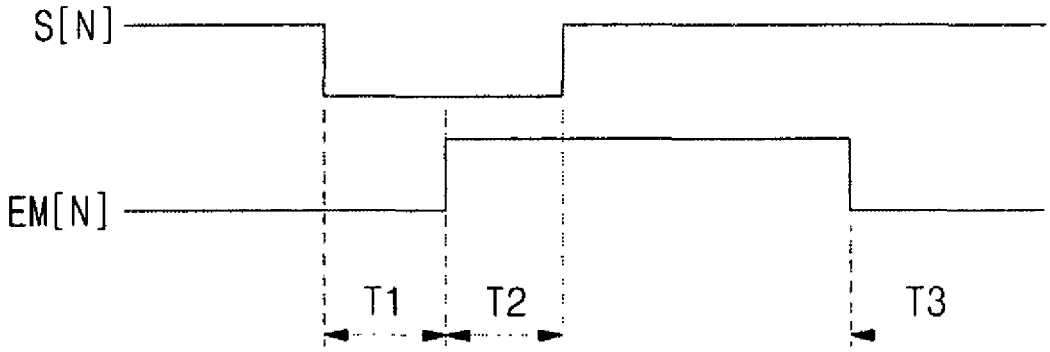
FIG. 3 is a driving timing diagram of the pixel circuit shown in FIG. 2.

Referring to FIG. 3, a driving timing diagram of the pixel circuit shown in FIG. 2 is depicted. As shown in FIG. 3, in the pixel circuit of the organic light emitting display, one frame can be classified into the first period, the second period and the third period. More particularly, one frame can comprise a data writing period (T1), a period for storing the threshold voltage of the driving transistor (T2), and an emission period (T3). Various ratios of the data writing period (T1) to the period for storing the threshold voltage of the driving transistor (T2) to the emission period (T3) can be formed. In some embodiments, the data writing period (T1) and the period for storing the threshold voltage of the driving transistor (T2) are shorter than the emission period (T3).

Figure 4:
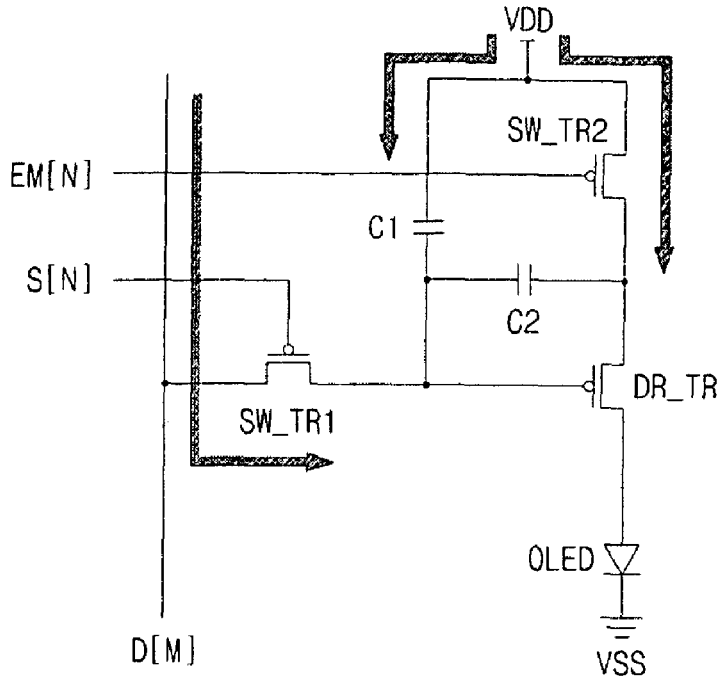
FIG. 4 is a drawing depicting how a current flows through the pixel circuit shown in FIG. 2 during the data writing period (T1)

Referring to FIG. 4, it is depicted how current flows through the pixel circuit shown in FIG. 2 during the data writing period (T1). The operation of the pixel circuit mentioned above will be described with reference to the timing diagram of FIG. 3.

The first switching transistor (SW_TR1) is turned on as a scan signal of low level is applied to the control electrode of the first switching transistor (SW_TR1). Then the second switching transistor (SW_TR2) is turned on as a signal of low level of the emission control line (EM[N]) is applied to the control electrode of the second switching transistor (SW_TR2).

As the first switching transistor (SW_TR1) is turned on, a data voltage (Vdata) of the data line (D[M]) is applied in a direction from the first electrode of the first switching transistor (SW_TR1) to the second electrode of the first switching transistor (SW_TR2). Consequently, the data voltage (Vdata) is applied to the second electrode of the first switching transistor (SW_TR1), the second electrode of the first storage capacitor (C1), the second electrode of the second storage capacitor (C2) and the control electrode of the driving transistor (DR_TR).

As the second switching transistor (SW_TR2) is turned on, a first power supply voltage from the first power supply line VDD is applied in a direction from the first electrode of the second switching transistor (SW_TR2) to the second electrode of the second switching transistor (SW_TR2). Consequently, the first power supply voltage is applied to the second electrode of the second switching transistor (SW_TR2), the first electrode of the second storage capacitor (C2) and the first electrode of the driving transistor (DR_TR).

In addition, the first power supply voltage from the first power supply line (VDD) can also be applied to the first electrode of the first storage capacitor (C1).

During the data writing period (T1) described above, the driving transistor (DR_TR) is turned off, thus no current flows through the organic light emitting diode (OLED), Consequently, the organic light emitting diode (OLED) does not emit light.

During the data writing period (T1), the voltage of Vdata is applied to the control electrode (gate electrode) of the driving transistor (DR_TR), the second electrode of the second storage capacitor (C2) and the second electrode of the first storage capacitor (C1). In addition, the voltage of VDD is applied to the first electrode (source electrode) of the driving transistor (DR_TR), the first electrode of the second storage capacitor (C2) and the first electrode of the first storage capacitor (C1). Accordingly, the voltage (VDD-Vdata), is stored in the storage capacitors.

Figure 5:
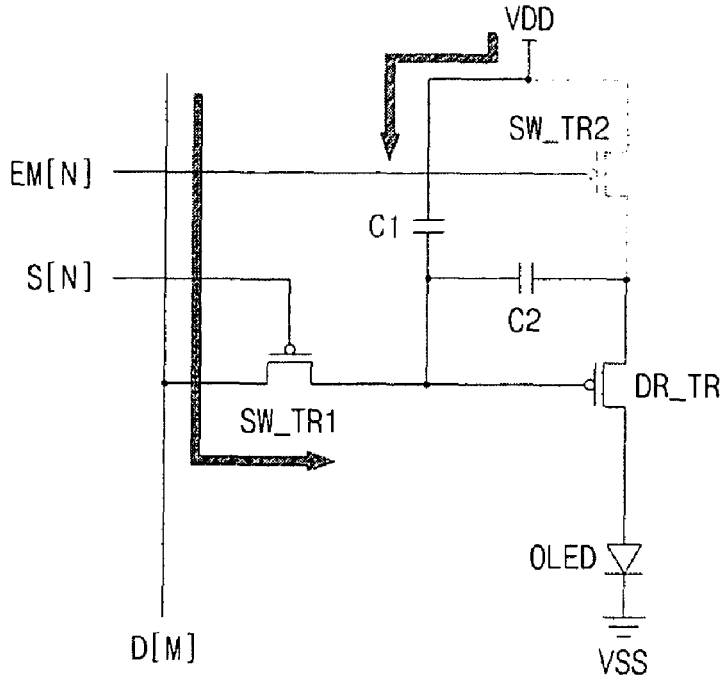
FIG. 5 is a drawing depicting how a current flows through the pixel circuit shown in FIG. 2 during the period for storing the threshold voltage of a driving transistor (T2)

Referring to FIG. 5, it is depicted how a current flows through the pixel circuit shown in FIG. 2 during storing the threshold voltage of the driving transistor (T2). Here, the operation of the pixel circuit will be described with reference to the timing diagram of FIG. 3.

First of all, the first switching transistor (SW-TR1) is turned on as a scan signal of low level from the scan line (S[N]) is applied to the control electrode of the first switching transistor (SW_TR1), and the second switching transistor (SW_TR2) is turned off as a signal of high level from the emission control line (EM[N]) is applied to the control electrode of the second switching transistor (SW_TR2).

As the first switching transistor (SW_TR1) is turned on, a data voltage (Vdata) of the data line (D[M]) is applied from the first electrode of the first switching transistor (SW_TR1) to the second electrode of the first switching transistor (SW_TR1). Consequently, the data voltage (Vdata) can be applied to the second electrode of the first switching transistor (SW_TR1), the second electrode of the first storage capacitor (C1), the second electrode of the second storage capacitor (C2) and the control electrode of the driving transistor (DR_TR).

Here, as the second switching transistor (SW_TR2) is turned off, a first power supply voltage from the first power supply line (VDD) can be applied to the first electrode of the first storage capacitor (C1).

During the period for storing the threshold voltage of the driving transistor (T2) described above, the driving transistor (DR_TR) is turned off, thus no current is applied to the organic light emitting diode (OLED). Consequently, the organic light emitting diode (OLED) does not emit light.

During the period for storing the threshold voltage of the driving transistor (T2), the voltage of Vdata is applied to the control electrode (gate electrode) of the driving transistor (DR_TR), the second electrode of the second storage capacitor (C2) and the second electrode of the first storage capacitor (C1). In addition, the voltage of VDD is applied to the first electrode of the first storage capacitor (C1). Accordingly, the voltage (VDD-Vdata) is stored in the first storage capacitor (C1).

Here, the voltage (Vs) of the first electrode (source electrode) of the driving transistor (DR_TR) is a value (Vs=Vdata+Vth). Accordingly, the voltage (Vth) of the driving transistor (DR_TR) is stored in the second storage capacitor (C2).

Referring to the timing diagram of FIG. 3, at the beginning of the third period (T3), the first switching transistor (SW_TR1) is turned off as a signal of high level is applied from the scan line (S[N]) to the control electrode of the first switching transistor (SW_TR1), and the second switching transistor (SW_TR2) is turned off as a signal of high level is applied from the emission control line (EM[N]) to the control electrode of the second switching transistor (SW_TR2).

Accordingly, during the third period (T3), the voltage stored in the storage capacitors during the second period (T2) is maintained without any changes.

Figure 6:
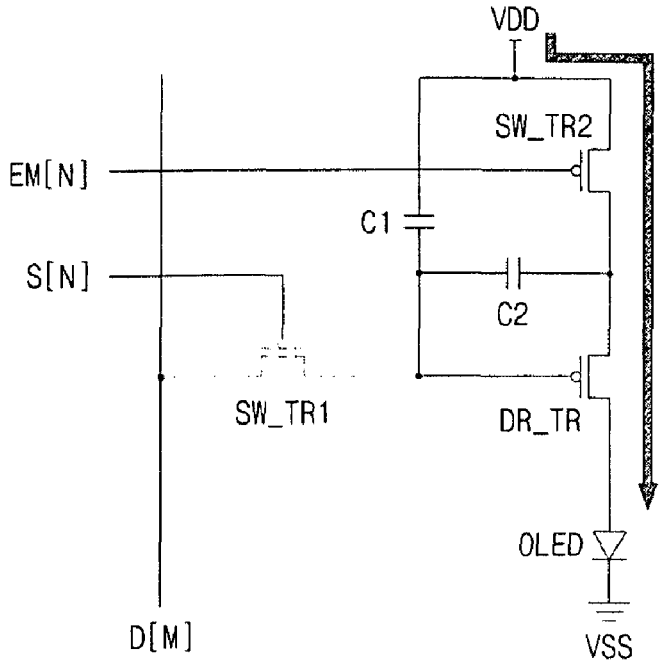
FIG. 6 is a drawing depicting how a current flows through the pixel circuit shown in FIG. 2 during the emission period (T3)

Referring to FIG. 6, it is depicted how a current flows through the pixel circuit shown in FIG. 2 during the emission period (T3). Here, the operation of the pixel circuit will be described with reference to the timing diagram of FIG. 3.

The first switching transistor (SW_TR1) is turned off as a signal of high level from the scan line (S[N]) is applied to the control electrode of the first switching transistor (SW_TR1), and the second switching transistor (SW_TR2) is turned on as a signal of low level of the emission control line (EM[N]) is applied to the control electrode of the second switching transistor (SW_TR2).

As the first switching transistor (SW_TR1) is turned off, a data voltage (Vdata) of the data line (D[M]) is not further applied to the pixel circuit.

Here, as the second switching transistor (SW_TR2) is turned on, a first power supply voltage from the first power supply line (VDD) is applied from the first electrode of the second switching transistor (SW_TR2) to the second electrode of the second switching transistor (SW_TR2). Consequently, the first power supply voltage can be applied to the first electrode (source electrode) of the driving transistor (DR_TR). A current from the first power supply line (VDD) can flow toward the second power supply line (VSS) through the organic light emitting diode (OLED) during the emission period (T3). Accordingly, the organic light emitting diode can emit light.

During the emission period (T3), the voltage (Vs) of the first electrode (source electrode) of the driving transistor (DR_TR) becomes VDD. In addition, the voltage (Vg) of the control electrode (gate electrode) of the driving transistor (DR_TR) and the voltage difference (Vsg) between the source electrode and the gate electrode of the driving transistor (DR_TR) can be calculated from the Formula 1 in the following.

$$V_g = V_{data} + \left(\frac{C2}{C1 + C2}\right) * (VDD - V_{data} - Vth) \quad \text{[Formula 1]}$$

$$V_S = VDD$$

$$V_{Sg} = V_S - V_g$$

$$V_{Sg} = VDD - \left[V_{data} + \left(\frac{C2}{C1 + C2}\right) * (VDD - V_{data} - Vth)\right]$$

The current flowing through the organic light emitting diode (OLED) can be calculated from the Formula 2 in the following.

$$I_{OLED} = \frac{\beta}{2} * (V_{Sg} - |Vth|)^2 \quad \text{[Formula 2]}$$

That is to say, the threshold voltage (Vth) of the driving transistor (DR_TR) is stored in the second storage capacitor (C2) during the second period (T2). Subsequently, data is expressed by the data voltage (Vdata) and the ratio of C1 to C2 during the emission period (T3).

Here, the optimal ratio of C1 to C2 can change according to the variation of the threshold voltage (Vth) of the driving transistor included in respective pixel circuit. For example, if the variation of the threshold voltage (Vth) at the panel of the organic light emitting display is 0.1V, it can be said that the image quality's not affected. However, if the variation of the threshold voltage (Vth) during the fabricating process is 0.5V, degradation of the image quality can occur. However, if the ratio of C1 to C2 is set to 1:5 (C1:C2=1:5), even if the variation of the threshold voltage (Vth) during the fabricating process is 0.5V, the effective variation of the threshold voltage (Vth) at the panel can be smaller than 0.1V. Consequently, the image quality has no problem.

If, C2 is set to have a larger value than that of C1 (that is, C2>>C1), C2 divided by C1 added to C2 (C2/(C1+C2)) can be approximately 1. Here, only Vth is left in Vsg in the Formula 1 described above. In addition, when Vsg is substituted with Vth in Formula 2, the threshold voltage (Vth) of the driving transistor can be compensated to a current flowing through the organic light emitting diode (OLED).

If C2 is much larger than C1, then C2 divided by C1 added to C2 (C2/(C1+C2) becomes 1, Vsg becomes Vth. Here, no matter how much Vdata changes, Vsg of the driving transistor (DR_TR) is Vth. Therefore, as shown in Formula 2, no data voltage (Vdata) appears in the Formula of the organic light emitting diode. Accordingly, the current wanted according to a data voltage (Vdata) cannot be generated. Therefore, the data range expands infinitely. Nevertheless, if C1 is set to have a much larger value than that of C2, then C2 divided by C1 added to C2 (C2/(C1+C2)) becomes 0 approximately. Consequently, Vsg in Formula 1 becomes VDD-Vdata. As a result, the current wanted can be generated according to a data voltage (Vdata). However, the compensation for the threshold voltage (Vth) of the driving transistor (DR_TR) or the compensation for IR-drop of the first power supply line (VDD) cannot be accomplished properly.

That is to say, in the organic light emitting display, the threshold voltage (Vth) of the driving transistor (DR_TR) and IR-drop by the first power supply line (VDD) can be compensated by controlling the ratio of C1 to C2 properly.

For example, if C2 divided by C1 added to C2 (C2/(C1+C2)) is 0.5, Vsg becomes VDD−Vdata−0.5 VDD+0.5 Vdata+0.5 Vth. Consequently, the data range is increased twofold, and the influence of the threshold voltage (Vth) of the driving transistor (DR_TR) and IR-drop of the first power supply line (VDD) can be reduced to half. That is, the influence of the threshold voltage (Vth) of the driving transistor (DR_TR) and IR-drop of the first power supply line (VDD) can be minimized by determining C2 to have a larger value than that of C1.

Furthermore, conventional circuits for compensating the threshold voltage of a driving transistor and IR-drop of a first power supply line require more diodes than the pixel circuit of FIG. 2. Therefore, it can be difficult to accomplish high integration. However, the pixel circuit of FIG. 2 can accomplish high integration because it consists of only three transistors and two storage capacitors. Consequently, an organic light emitting display of high resolution can be realized.

In some circuits for compensating the threshold voltage of a driving transistor, because a path is formed from a control electrode of the driving transistor to a negative power supply voltage, a leakage current can flow through the path. In the circuit of FIG. 2, if the leakage current (off current of the driving transistor) is large, although a black image should be expressed, improper emission can be generated by the leakage current which flows into the organic light emitting diode (OLED). Because the leakage characteristics of driving transistors in a panel differ from one another, although a black image should be expressed, some pixels which have large leakage characteristics can emit some light. The improper emission described above can be reduced by having the driving transistor undergo a reverse aging because the reverse aging can reduce the leakage current of the driving transistor. However, the pixel circuit of FIG. 2 has essentially no leakage. Consequently, the reverse aging for the driving transistor described above is not required.

Preferably, the data writing period (T1) and the period for storing the threshold voltage of the driving transistor (T2) should be shorter than the emission period (T3) so that the time during which the organic light emitting diode (OLED) emits light can become maximized.

Figure 7:
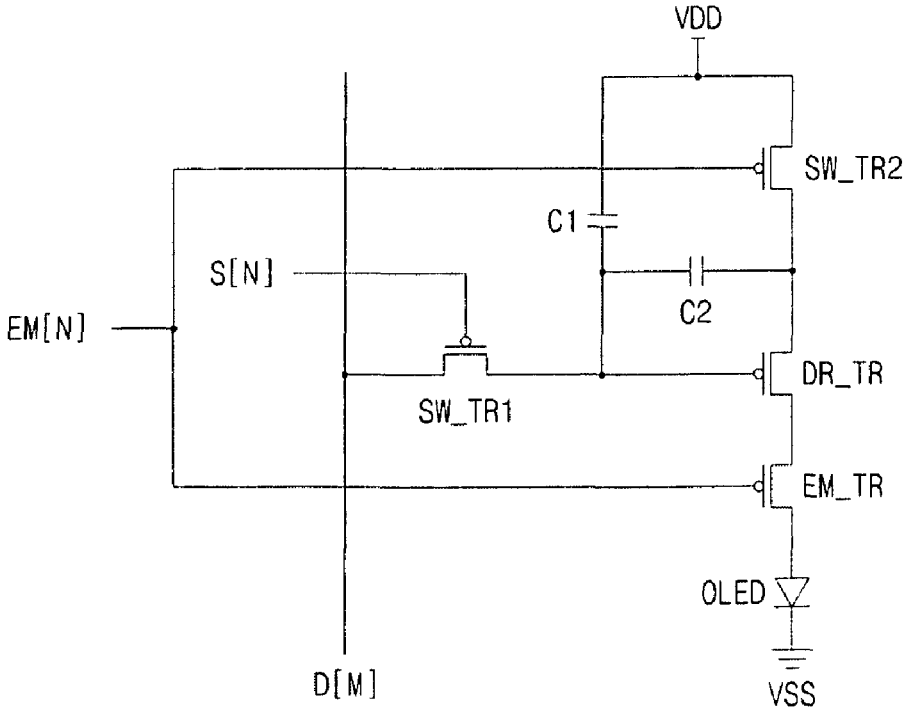
FIG. 7 is a circuit diagram depicting a pixel circuit according to another embodiment.

Referring to FIG. 7, a pixel circuit according to another embodiment of the organic light emitting display is depicted. The pixel circuit shown in FIG. 7 is similar to the pixel circuit shown in FIG. 2. However, the pixel circuit shown in FIG. 7 also includes an additional emission control switching transistor (EM_TR).

The emission control switching transistor (EM_TR) includes a control electrode coupled to the emission control line (EM[N]), a first electrode coupled to the second electrode of the driving transistor, and a second electrode coupled to the anode of the organic light emitting diode (OLED). The emission control switching transistor controls a current which flows from the first power supply line (VDD) to the second power supply line (VSS) through the organic light emitting diode (OLED). During the emission period (T3), the emission control signal switching transistor (EM_TR) is turned on as a signal of low level from the emission control line (EM[N]) is applied to the control electrode of the emission control switching transistor (EM_TR). Consequently, the organic light emitting diode (OLED) emits light according to the current which flows from the first power supply line (VDD) to the second power supply line (VSS) through the organic light emitting diode (OLED).

As shown in FIG. 7, a P type channel transistor is used as the emission control switching transistor (EM_TR).

Figure 8:
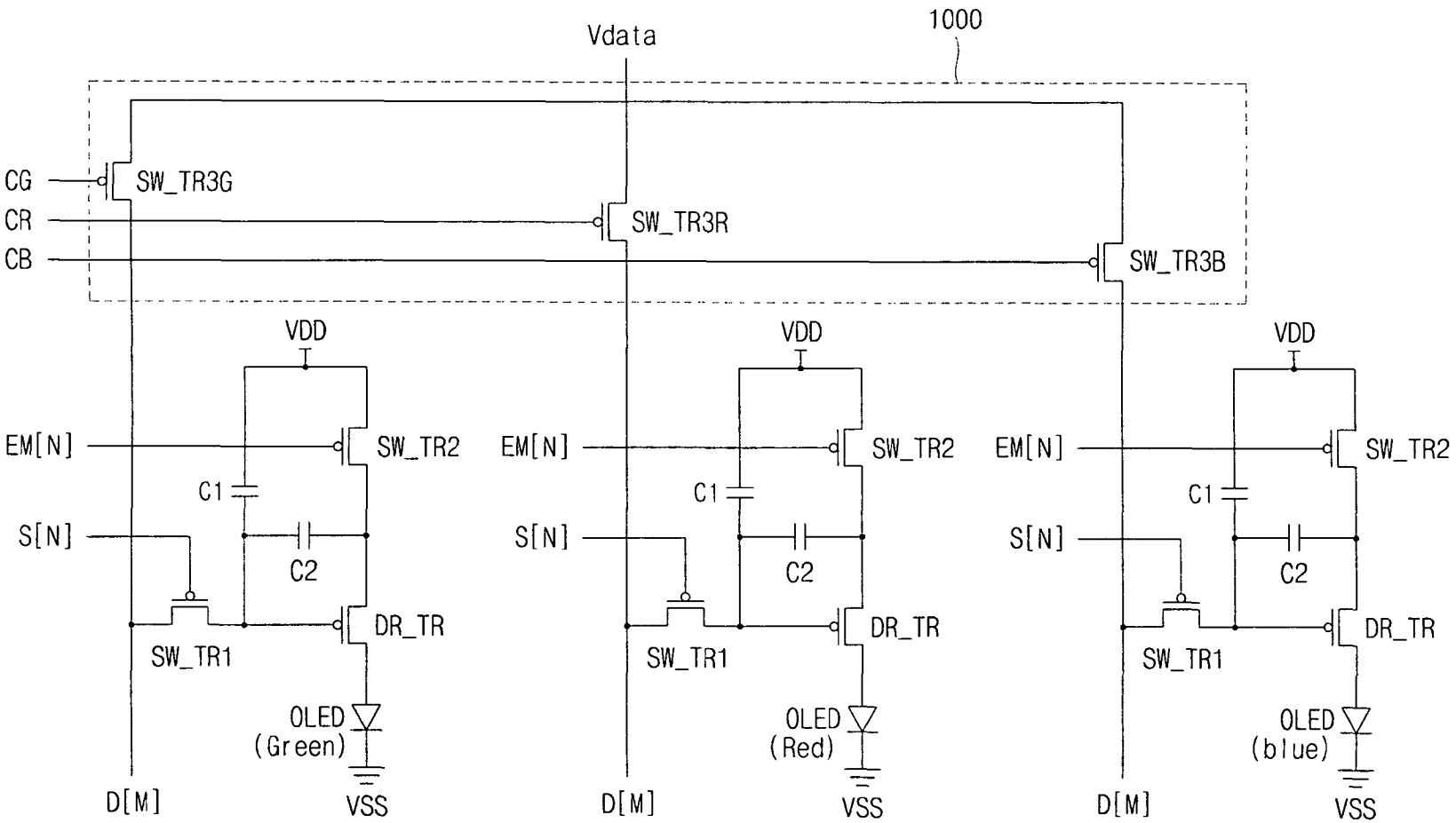
FIG. 8 is a drawing depicting how RGB pixel circuits and a demux are coupled according to an embodiment.

Referring to FIG. 8, RGB pixel circuits and a demux are coupled according to one embodiment.

The demux may have a layout structure which corresponds to each RGB data signal of the data driver of the organic light emitting display.

Because high resolution is required, the number of data lines of the organic light emitting display increases, and the data driver which drives the organic light emitting display includes more integrated circuits. To solve the problem of excessive data lines, a demux which includes fewer output lines of the data driver may be used. The demux includes a plurality of data supplying switching elements which are connected in common to of the data driver, and the respective data supplying switching elements are coupled to separate data lines. Therefore, the demux supplies each data line with a data signal in sequence through the operation of the data supplying switching elements.

Herein, RGB means red (Red, R), green (Green, G) and blue (Blue, B). In FIG. 8, three pixel circuits are coupled to the demux 1000, however, the number of pixel circuits is not limited. In addition, a data signal can be applied to pixel circuits by using a plurality of demuxes, the number of demuxes used is not limited.

In the demux 1000, each red data line, green data line and blue data line is coupled to the data line (D[M]) of the respective pixel circuits. In addition, each RGB data line is coupled to a RGB switching transistor (SW_TR3). The RGB switching transistor can consist of a red data line switching transistor (SW_TR3R), a green data line switching transistor (SW_TR3G) and a blue data line switching transistor (SW_TR3G). RGB control signal can be applied to a control electrode of the RGB switching transistors through RGB control lines (CR, CG and CB) respectively.

Once the RGB switching transistor is turned on by the RGB control signal (CR, CG and CB), a proper data signal (voltage) can be applied to each RGB pixel circuit from the data driver through the demux.

The RGB switching transistors can be P type channel transistors, but the kind of the RGB switching transistor is not limited.

Figure 9:
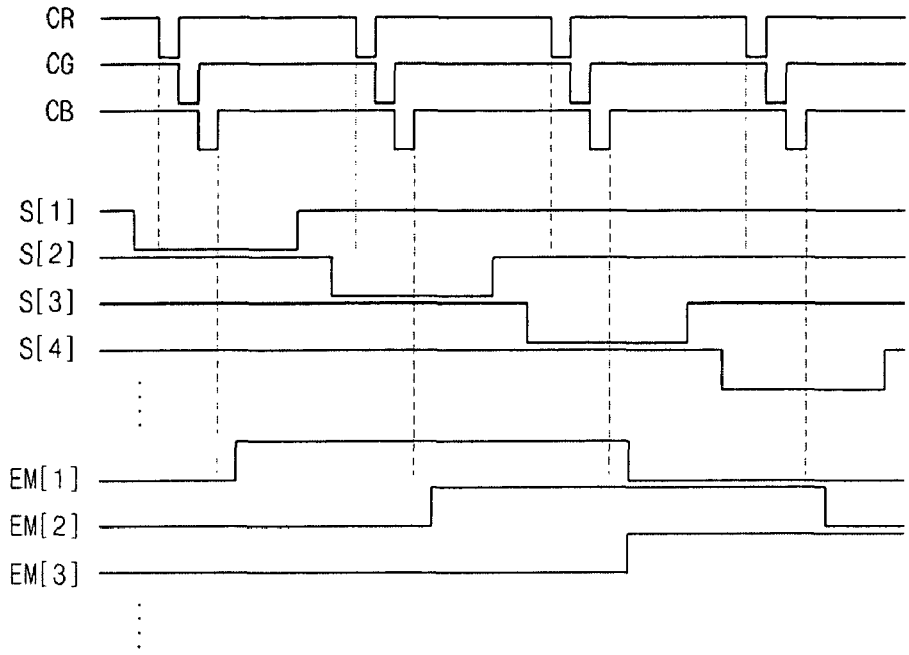
FIG. 9 is a driving timing diagram according to an embodiment of the RGB circuits shown in FIG. 8.
Figure 10:
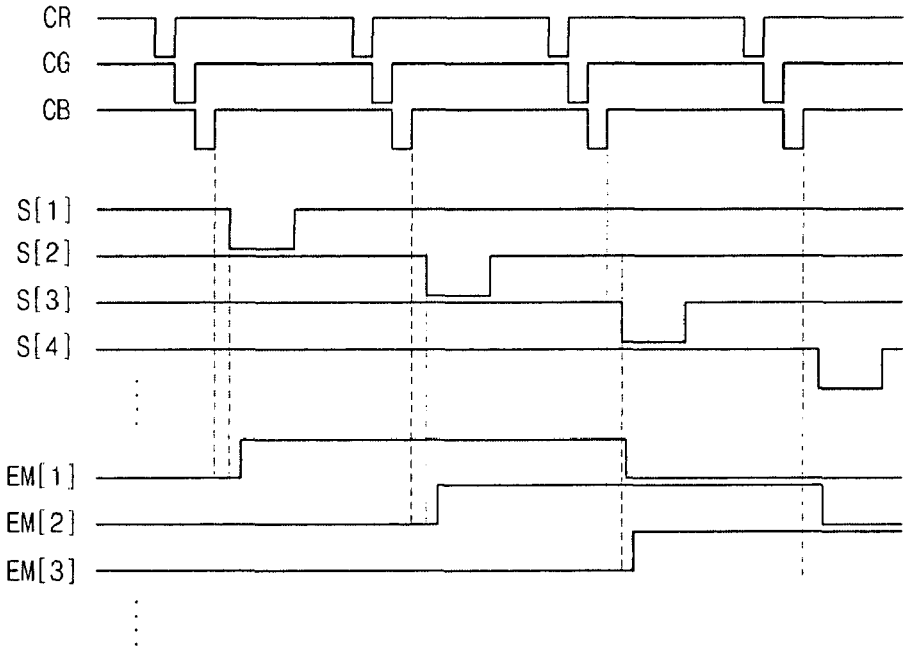
FIG. 10 is a driving timing diagram according to an embodiment of the RGB circuits shown in FIG. 8.

Referring to FIG. 9 and FIG. 10, a driving timing diagram of the RGB pixel circuit of FIG. 8 is depicted.

First of all, the operation of the RGB pixel circuits shown in FIG. 8 will be described with reference to the driving timing diagram of FIG. 9.

Once a scan signal of low level is applied through the scan line (S[N]), each first switching transistor (SW_TR1) of the RGB pixel circuits is turned on. And, once a low level emission control signal is applied through the emission control line (EM[N]), each second switching transistor (SW_TR2) of the RGB pixel circuits is turned on.

In a driving method for the organic light emitting display as shown in FIG. 9, the RGB switching transistors (SW_TR3) are turned on by applying a signal of low level through the RGB control lines (CR, CG and CB) during a period during which the scan signal and the emission control signal are low level. Consequently, the RGB data signal can be applied.

When a P type channel transistor is used as shown in FIG. 8, the RGB switching transistors (SW_TR3) are turned on when a signal of low level is applied to them, as described above. However, if an N type channel transistor is used, the RGB switching transistor (SW_TR3) are turned on as a signal of high level is applied to them. Consequently, the driving timing diagrams can be different. However the kind of the transistor and the driving timing diagram are not limited to the specific examples described.

The operation of the RGB pixel circuits shown in FIG. 8 will be described with reference to the driving timing diagram of FIG. 10.

As a signal of high level is applied through the scan line (S[N]), each first switching transistor (SW_TR1) of the RGB pixel circuits is turned off. And, as a signal of low level is applied through the scan line (S[N]), each second switching transistor (SW_TR2) of the RGB pixel circuits is turned on.

In a driving method for the organic light emitting display shown in FIG. 10, the RGB switching transistors (SW_TR3) are turned on by applying a signal of low level through the RGB control lines (CR, CG and CB) during the period during which the scan signal is high level and the emission control signal is low level. Consequently, the RGB data signal can be applied.

When a scan signal of high level is applied to the control electrode of the first switching transistor (SW_TR1) of the pixel circuit, the first switching transistor (SW_TR1) is turned off. Consequently, during the period which a turn-off scan signal is applied, the RGB data signal is not applied to the storage capacitor of the pixel circuit. Once the first switching transistor (SW_TR1) is turned on as a turn-on scan signal is applied to the control electrode of the first switching transistor (SW_TR1) after the data signal (voltage) is charged by a parasitic capacitor (Cd) formed by the data lines (D[M]), the data signals charged in the parasitic capacitor (Cd) is applied through the first switching transistor (SW_TR1). The capacitance of the parasitic capacitor (Cd) can be larger than that of the first storage capacitor (C1) and the second storage capacitor (C2) included in the pixel circuit.

In case that a P type channel transistor is used as shown in FIG. 8, the RGB switching transistors (SW_TR3) are turned on when a signal of low level is applied to them. However, if an N type channel transistor is used, the RGB switching transistors (SW_TR3) are turned on as a signal of high level is applied to them. Consequently, the driving timing diagrams can be different. However, the kind of the transistor and the driving timing diagram is not limited to those disclosed in the specification.

As describe above, the RGB switching transistors (SW_TR3) are turned on by applying a signal of low level through the RGB control lines (CR, CG and CB) during the period which a signal of low level is applied from the emission control line (EM[N]), regardless of whether a high level or low level is applied from the scan line (S[N]). As a results, the storage capacitors, which have stored a previous data voltage, can be initialized as they are coupled to the first power supply line (VDD). Furthermore, the storage capacitors can be coupled to the first power supply line (VDD) as the second switching transistors (SW_TR2) of the pixel circuits are turned on by a signal of low level applied from the emission control line (EM[N]). Consequently, proper data can be written on the storage capacitors by applying new RGB data signals after the storage capacitors are initialized.

Figure 11:
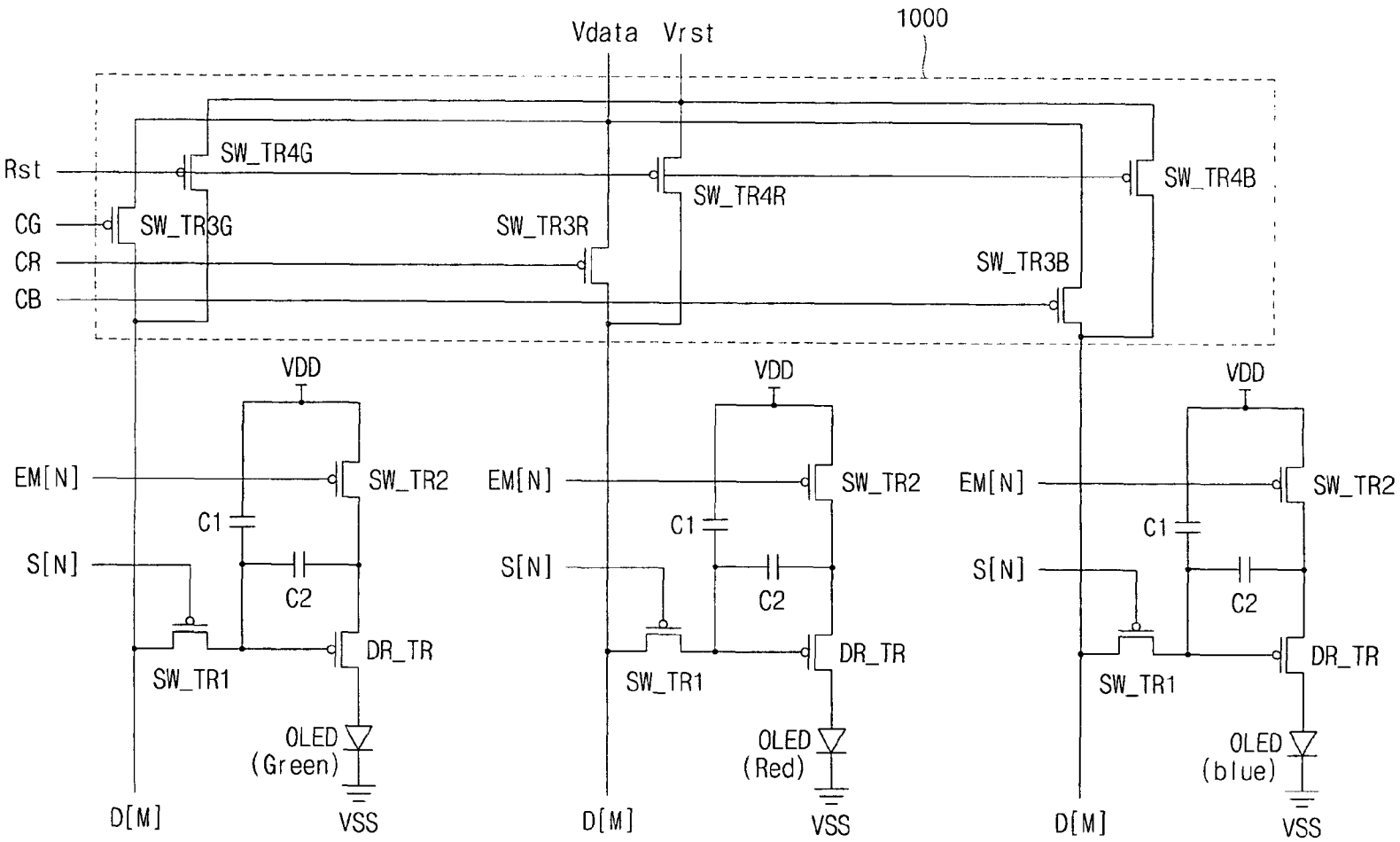
FIG. 11 is a drawing depicting how RGB pixel circuits and a demux are coupled according to an embodiment.

FIG. 11 depicts how the RGB pixel circuits and the demux may be coupled.

The demux 1000 has a layout structure corresponding to each RGB data signal of the data driver of the organic light emitting display, and it is similar to the demux shown in FIG. 8. However, the Demux 1000 also includes an initializing power supply voltage line (Vrst) and an initializing switching transistor (SW_TR4) which couples the initialing power supply voltage line (Vrst) to a RGB data voltage line.

Three pixel circuits are coupled to the demux 1000 in FIG. 11, however, the number of pixel circuits coupled to the demux is not limited. In addition, a data signal can be applied to the pixel circuits by using a plurality of demuxes, and the number of demuxes used is not limited.

In the demux 1000 shown in FIG. 11, each red data line, green data line and blue data line is coupled to the data line (D[M]) of the respective pixel circuits. In addition, each RGB data line is coupled to RGB switching transistor (SW_TR3). The RGB switching transistor can comprise a red data line switching transistor (SW_TR3R), a green data line switching transistor (SW_TR3G) and a blue data line switching transistor (SW_TR3G). RGB control signals can be applied to a control electrode of the RGB switching transistors through RGB control lines (CR, CG and CB) respectively.

Once the RGB switching transistor is turned on by the respective RGB control signals (CR, CG and CB), a proper data signal (voltage) from the data driver can be applied to the respective RGB pixel circuit through the demux.

In addition, the initializing power supply voltage line (Vrst) is coupled to the respective RGB data line through the initializing switching transistor (SW_TR4). Once a turn-on initializing signal (Rst) is applied to the initializing switching transistor (SW_TR4), the initializing switching transistors (SW_TR4G, SW_TR4R and SW_TR4B) are turned on, then an initializing power supply voltage can be applied to each RGB data line from the initializing power supply voltage line (Vrst). As the initializing power supply voltage is applied, the previous data voltages applied to the RGB data lines are initialized. Consequently, new RGB data signals (voltages) can be applied.

The RGB switching transistor and the initializing power supply voltage can be a P type channel transistor, however, the kind of the transistor is not limited.

A thin film transistor can be used as the RGB switching transistor (SW_TR3) shown in FIG. 8 and the initializing switching transistor (SW_TR4) shown in FIG. 11. Furthermore, as a crystallization method for the thin film transistor, a laser crystallization method (ELA) using an excimer laser, a metal induced crystallization (MIC) using a catalytic metal and a solid phase crystallization can be used. In addition, a high pressure annealing (HPA) wherein crystallization is executed at a high temperature and a high humidity environment and a sequential lateral solidification using a mask in addition to conventional laser crystallization can be used as well.

The laser crystallization method is a widely used crystallization method in which a thin film transistor is crystallized into poly silicon. Not only can the method directly use existing crystallization processes for poly silicon liquid crystal display devices, but also the process is simple, and the technology of the process has been completely established.

Figure 12:
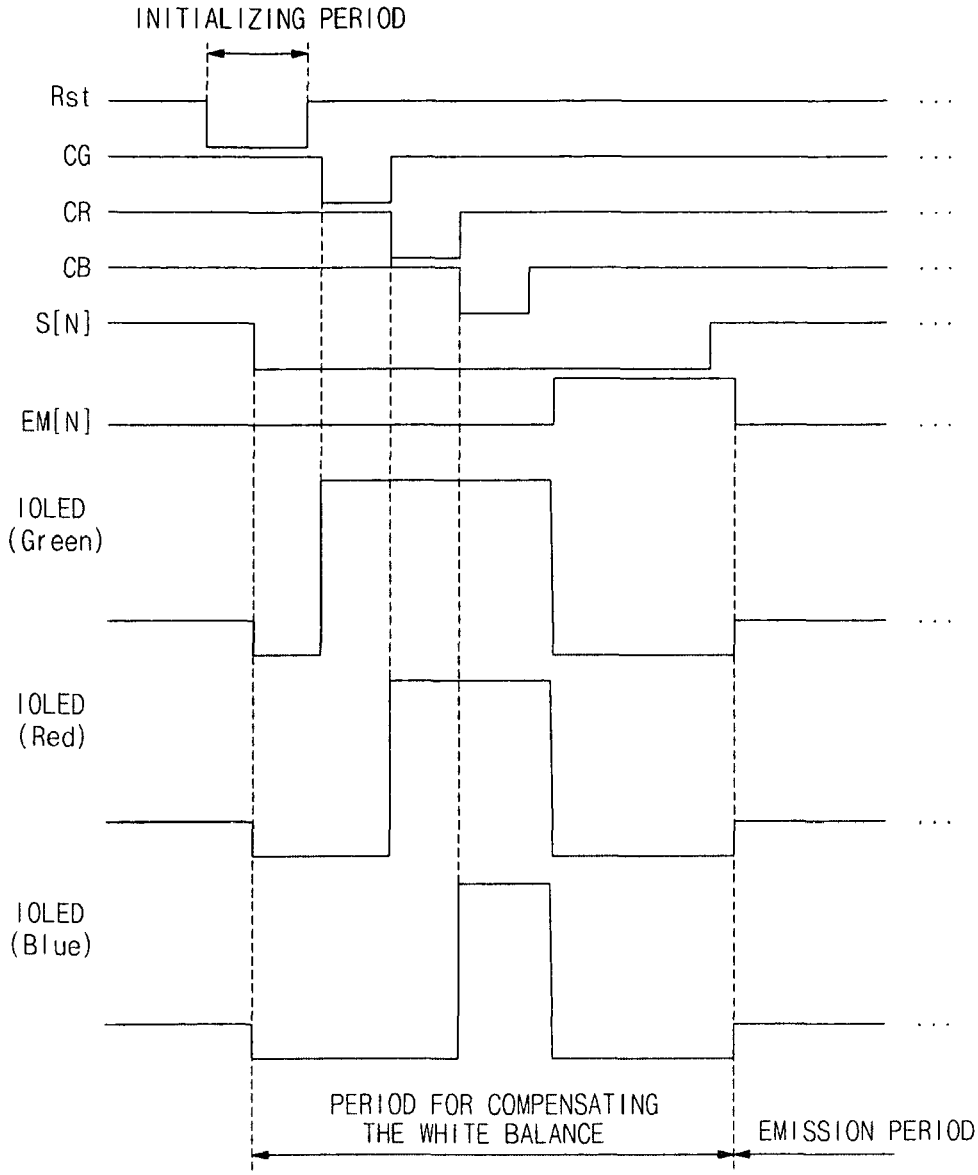
FIG. 12 is a driving timing diagram of the RGB pixel circuits shown in FIG. 11.

Referring to FIG. 12, a driving timing diagram of the RGB pixel circuits shown in FIG. 11 is depicted.

The operation of the RGB pixel circuits shown in FIG. 11 will be described with reference to the driving timing diagram of FIG. 12.

Once an initializing signal of low level is applied through an initializing signal line (Rst), the initializing switching transistors (SW_TR4) in the demux are turned on. Consequently, data lines are initialized by the initializing power supply voltage from the initializing power supply voltage line (Vrst).

Once an emission control signal of low level is applied through the emission control line (EM[N]), and a scan signal of low level is applied from the scan line (S[N]), then the RGB switching transistors (SW_TR3R, SW_TR3G and SW_TR3B) can be turned on as a signal of low level is applied through the RGB control signal line.

The RGB control signal is applied in order of a green, red and blue control signals. Consequently, the RGB data voltage is applied to the respective green, red and blue pixel circuits in sequence.

As shown in FIG. 12, a green organic light emitting diode (OLED Green) emits light as a current flows through the green organic light emitting diode (OLED Green) from the period during which a green emission control signal is applied to the period during which an emission control signal of high level from the emission control line (EM[N]) is applied.

A red organic light emitting diode (OLED Red) emits light as a current flows through the red organic light emitting diode (OLED Red) from the period during which a red emission control signal is applied to the period during which an emission control signal of high level from the emission control line (EM[N]) is applied.

In addition, a blue organic light emitting diode (OLED Blue) emits light as a current flows through the blue organic light emitting diode (OLED Blue) from the period during which a blue emission control signal is applied to the period during which an emission control signal of high level from the emission control line (EM[N]) is applied.

As shown in FIG. 12, during the period for compensating the white balance, a current flows through a green organic light emitting diode for the longest time, and a red green organic light emitting diode is next, and a blue organic light emitting diode is the shortest.

In this embodiment, the reason why the time for compensating the white balance is arranged in order of green, red and blue is that a green OILED has a higher luminous efficiency than red and green OLEDs. To adjust the white balance, a current flows through a green organic light emitting diode of the best luminous efficiency for the longest time during the non-emission period (the period for compensating the white balance). Next, in order of a red and blue, the period for compensating the white balance is performed. Therefore, a uniform luminance can be accomplished. In some embodiments, during the period for compensating the white balance, a larger current flows through the organic light emitting diode than a current flowing during the emission period.

In some embodiments, during a period for displaying a frame, the period for compensating the white balance can be shorter than the emission period.

As described above, the organic light emitting display can divide a period for displaying one frame into the first period (T1), the second period (T2) and the third period (T3). Each period consists of a data writing period (T1), a period for storing the threshold voltage of the driving transistor (T2) and an emission period (T3).

In the organic light emitting display, high integration can be accomplished by using three transistors, which is fewer than the number of the transistors of a conventional pixel circuit. Consequently, high resolution also becomes possible.

The uniformity of the luminance can be improved by compensating the threshold voltage (Vth) and controlling the ratio (C1:C2) of a first storage capacitor to a second storage capacitor properly. Furthermore, IR-drop by a first power supply line (VDD) can be improved by controlling the capacitance ratio of the first storage capacitor to the second storage capacitor.

In the pixel circuit, an improper emission of the organic light emitting diode can be suppressed because an electric connection through which a leakage current can flow from one control electrode of the driving transistor to the negative power supply voltage does not exist.

In the case of a driving method an RGB data signal is applied by using the demux, the RGB data signal is applied during a period which an emission control signal is turned on regardless of the scan signal being turned on or off. Consequently, the RGB data can be stored in each storage capacitor properly. A new RGB data signal can be stored in the storage capacitors properly because the respective storage capacitors are initialized by the first power supply voltage of the first power supply line, before the RGB data is applied to each storage capacitor of the respective pixel circuits.

Furthermore, in the case of one driving method, an RGB data signal is applied using the demux during the non-emission period (the period for compensating the white balance). During this period a current should flow through the light emitting diode of the longest lifetime for the longest time. Next, in order of a red and blue organic light emitting diode, the period for compensating the white balance is performed. Consequently, the lifetime of uniform luminance level can be extended. Accordingly, the color wanted can be reproduced because the white balance is maintained as time goes by, because the period for compensating the white balance is performed.

What is claimed is:

1. An organic light emitting display, comprising:

a scan line;

a data line; and a pixel coupled to the scan line and the data line;

wherein the pixel comprises:

a first switching transistor including a control electrode coupled to the scan line, and a first electrode coupled to the data line;

a driving transistor connected between a first power supply line and a second power supply line, the driving transistor including a control electrode coupled to the first switching transistor;

a first storage capacitor connected to the first switching transistor, the first power supply line and the driving transistor;

a second switching transistor connected between the first power supply line and the driving transistor, the second switching transistor comprising a control electrode coupled to an emission control line;

a second storage capacitor connected to the first switching transistor and connected to the first storage capacitor and connected to the second switching transistor and connected to the driving transistor; and an organic light emitting diode coupled between the driving transistor and the second power supply line, wherein the second storage capacitor is not a parasitic capacitor of the driving transistor.

2. The organic light emitting display as claimed in claim 1, wherein the first switching transistor includes an electrode coupled to the control electrode of the driving transistor.

3. The organic light emitting display as claimed in claim 1, wherein the first switching transistor is configured to transfer data from the data line to the driving transistor while the control electrode of the first switching transistor receives a scan signal from the scan line.

4. The organic light emitting display as claimed in claim 1, wherein the control electrode of the driving transistor is coupled to the first switching transistor, the driving transistor including a first electrode coupled to the second switching transistor, and a second electrode coupled to an anode of the organic light emitting diode.

5. The organic light emitting display as claimed in claim 1, wherein the driving transistor is configured to control a driving current from the first power supply line according to a data signal at the control electrode of the driving transistor.

6. The organic light emitting display as claimed in claim 1, wherein the first storage capacitor includes a first electrode coupled to the first power supply line, and a second electrode coupled to the first switching transistor and the control electrode of the driving transistor.

7. The organic light emitting display as claimed in claim 1, wherein the first storage capacitor includes a first electrode coupled to the first power supply line and a second electrode coupled to the second storage capacitor.

8. The organic light emitting display as claimed in claim 1, wherein the control electrode of the second switching transistor is coupled to the emission control line, and the second switching transistor includes a first electrode coupled to the first power supply line, and a second electrode coupled to the driving transistor.

9. The organic light emitting display as claimed in claim 1, wherein the control electrode of the second switching transistor is coupled to the emission control line, and the second switching transistor includes a first electrode coupled to the first power supply line, and a second electrode coupled to the second storage capacitor.

10. The organic light emitting display as claimed in claim 1, wherein the first electrode of the second storage capacitor is coupled to the second switching transistor and the driving transistor, and the second electrode of the second storage capacitor is coupled to the first storage capacitor, the first switching transistor, and the driving transistor.

11. The organic light emitting display as claimed in claim 1, wherein the second storage capacitor is coupled between the control electrode of the driving transistor and a first electrode of the driving transistor.

12. The organic light emitting display as claimed in claim 1, wherein the organic light emitting diode includes an anode coupled to the driving transistor and a cathode coupled to the second power supply line.

13. The organic light emitting display as claimed in claim 1, wherein a second power supply voltage of the second power supply line is lower than a first power supply voltage of the first power supply line.

14. The organic light emitting display as claimed in claim 1, wherein the second power supply voltage of the second power supply line is a ground voltage.

15. The organic light emitting display as claimed in claim 1, wherein during a period for displaying one frame, while the first switching transistor and the second switching transistor are turned on, a data voltage from the data line is applied to the first storage capacitor, the second storage capacitor, and the control electrode of the driving transistor, after which the first power supply voltage from the first power supply line is applied to the first storage capacitor and to the second storage capacitor.

16. The organic light emitting display as claimed in claim 1, wherein during a period for displaying one frame, while the first switching transistor is turned on, and the second switching transistor is turned off, a data voltage from the data line is applied to the first storage capacitor, the second storage capacitor, and the control electrode of the driving transistor, after which the first power supply voltage from the first power supply line is applied to the first storage capacitor.

17. The organic light emitting display as claimed in claim 1, wherein during a period for displaying one frame, while the first switching transistor is turned off, and the second switching transistor is turned on, the first power supply line, the driving transistor, and the organic light emitting diode are coupled one another, and a current flows from the anode of the organic light emitting diode to the cathode of the organic light emitting diode.

18. The organic light emitting display as claimed in claim 1, wherein an emission control switching transistor is included between the driving transistor and the organic light emitting diode.

19. The organic light emitting display as claimed in claim 18, wherein the emission control switching transistor includes a control electrode coupled to the emission control line, a first electrode coupled to the second electrode of the driving transistor, and a second electrode coupled to the anode of the organic light emitting diode.

* * * * *

UNITED STATES PATENT AND TRADEMARK OFFICE

CERTIFICATE OF CORRECTION

PATENT NO. : 8,232,933 B2
APPLICATION NO. : 12/005699
DATED : July 31, 2012
INVENTOR(S) : Yangwan Kim It is certified that error appears in the above-identified patent and that said Letters Patent is hereby corrected as shown below:

On Title Page 1, Column 1, Line 1, (Item 75), please delete "Youngin-si" and insert therefore, --Yongin-si--.

In Column 3, Line 33, please delete "coupling" and insert therefore, --coupled--.

In Column 4, Line 28, please delete "(SW-TR2)" and insert therefore, --(SW_TR2)--.

In Column 4, Line 61, please delete "capacitor" and insert therefore, --transistor--.

In Column 6, Line 7, please delete "elelctrode" and insert therefore, --electrode--.

In Column 6, Line 20, please delete "proportion of" and insert therefore, --proportion to--.

In Column 6, Line 29, please delete "(DR_FR)" and insert therefore, --(DR_TR)--.

In Column 7, Line 15, please delete "(OLED)," and insert therefore, --(OLED).--.

In Column 7, Line 33, please delete "(SW-TR1)" and insert therefore, --(SW_TR1)--.

In Column 10, Line 55, after "to" please add, --the output line--.

In Column 11, Line 6, please delete "signal" and insert therefore, --signals--.

In Column 11, Line 10, please delete "signal" and insert therefore, --signals--.

In Column 11, Line 17, please delete "circuit" and insert therefore, --circuits--.

In Column 11, Line 37, please delete "transistor" and insert therefore, --transistors--.

In Column 11, Line 39, please delete "However" and insert therefore, --However,--.

In Column 12, Line 20, please delete "results," and insert therefore, --result,--.

In Column 14, Line 6, please delete "OILED" and insert therefore, --OLED--.

In Column 14, Line 43, please delete "one" and insert therefore, --the--.

Signed and Sealed this
Fifth Day of March, 2013

Teresa Stanek Rea
*Acting Director of the United States Patent and Trademark Office*